US010557681B2

(12) United States Patent
Cahill et al.

(10) Patent No.: US 10,557,681 B2
(45) Date of Patent: Feb. 11, 2020

(54) RAIL INTERFACE SYSTEM

(71) Applicant: TangoDown, Inc., Tucson, AZ (US)

(72) Inventors: Jeffrey Matthew Cahill, Tucson, AZ (US); Todd Elliot Smith, Covina, CA (US)

(73) Assignee: TangoDown, Inc., Tucson, AZ (US)

( * ) Notice: Subject to any disclaimer, the term of this patent is extended or adjusted under 35 U.S.C. 154(b) by 0 days.

(21) Appl. No.: 16/252,502

(22) Filed: Jan. 18, 2019

(65) Prior Publication Data

US 2019/0249949 A1 Aug. 15, 2019

Related U.S. Application Data

(60) Provisional application No. 62/619,530, filed on Jan. 19, 2018.

(51) Int. Cl.
*F41C 27/00* (2006.01)
*F41G 11/00* (2006.01)

(52) U.S. Cl.
CPC ..... *F41C 27/00* (2013.01); *F41G 11/001* (2013.01)

(58) Field of Classification Search
CPC ..... F41C 27/00; F41G 11/001; F41G 11/002; F41G 11/003
See application file for complete search history.

(56) References Cited

U.S. PATENT DOCUMENTS

| | | | | |
|---|---|---|---|---|
| 7,836,625 | B2 | 11/2010 | Swan et al. | |
| 9,222,749 | B1 * | 12/2015 | Nakayama | F41C 23/16 |
| 9,239,209 | B2 * | 1/2016 | Mayberry | F41G 11/005 |
| 9,341,441 | B2 | 5/2016 | Cheng et al. | |
| 9,581,412 | B2 | 2/2017 | Cheng et al. | |
| 9,772,161 | B1 * | 9/2017 | Cheng | F41C 23/16 |
| 10,101,118 | B2 | 10/2018 | Roberts et al. | |
| 10,240,901 | B1 * | 3/2019 | Cheng | F41G 11/003 |
| 2009/0038198 | A1 * | 2/2009 | Yu | F41G 11/003 42/90 |
| 2009/0100734 | A1 * | 4/2009 | Swan | F41C 23/16 42/71.01 |
| 2015/0267993 | A1 | 9/2015 | Cheng et al. | |
| 2016/0209175 | A1 * | 7/2016 | Sharron | F41G 11/003 |
| 2017/0138693 | A1 * | 5/2017 | Roberts | F41G 11/001 |
| 2017/0205183 | A1 * | 7/2017 | Ding | F41A 35/02 |

* cited by examiner

*Primary Examiner* — Gabriel J. Klein
(74) *Attorney, Agent, or Firm* — R. Tracy Crump

(57) ABSTRACT

The improved rail interface system uses a spring tensioned "locking" shoe that extends from the accessory body into the rail opening to restrictively engage the edges of the rail openings and hold the weapon accessory against the weapon or weapon component. The locking shoe mechanisms is incorporated into a weapon light mount but may be adapted for use with M-Lok® style rail openings without the use of specialized nuts and fasteners.

15 Claims, 4 Drawing Sheets

RAIL INTERFACE SYSTEM

This application claims the benefit of U.S. Provisional Application No. 62/619,530 filed Jan. 19, 2018, the disclosure of which is hereby incorporated by reference.

This invention relates to a rail interface system for small firearms, and in particular a rail interface system using a lever mechanism extending through a rail opening to provide the locking force that secures the accessories directly to the rail.

BACKGROUND OF THE INVENTION

Rail interface systems ("RIS"), also commonly referred to as rail accessory systems, is a generic term for a system for attaching weapon accessories to small firearms such as pistols, rifles and light machine guns. Common weapon accessories include tactical lights, laser aiming modules, forward hand grips, weapon sights and optics, and bipods. A variety of rail interface systems have been developed for military and civilian application, including Picatinny (MIL-STD-1913), KeyMod and M-Lok®. These rail interface systems are well known in the firearms industry and most weapon accessories are compatible with one or more rail interface system.

The M-LOK® RIS was developed by Magpul Industries, Corp. of Austin, Tex. and protected by several patents including U.S. Pat. Nos. 8,925,236; 9,239,209; 9,239,210; 9,429,388; and 9523,554. M-LOK® is a registered trademark of Magpul Industries, Corp. The M-LOK® RIS consists of a series of elongated rail openings ("slots") formed in the handguard, rail or other weapon component, and a specialized T-slot nut capable of only 90-degree rotation. The "quarter-turn" T-slot nuts have a "cammed" surface that allow the "T" section to engage the backside of the handguard or rail when the fastener bolts draw down on the nuts securing the attachment of the accessory. The cammed surface also allows the "T" section to disengage the backside of the handguard or rail when fasteners are loosened.

M-Lok is a popular rail interface system that aims to supersede the Picatinny military standard rail interface system (MIL-STD-1913). The M-Lok® rail interface system eliminates the need for weapon components, particularly handguards to be fully outfitted with "Picatinny" style rails. The M-Lok® RIS enables the user to have a slimmer, lighter, smoother and better fenestrated handguard/fore-end with accessories mounted only where needed, whereas a Picatinny handguard typically will have rail slots along its whole length resulting in a heavier and bulkier handguard with sharp edges and poorer barrel ventilation. However, the M-Lok® RIS requires the use of separate specialized fasteners.

SUMMARY OF INVENTION

The improved rail interface system of this invention uses a spring tensioned "locking" shoe that extends from the accessory body into the rail opening to restrictively engage the edges of the rail openings and hold the weapon accessory against the weapon or weapon component. The locking shoe may be adapted for use with M-Lok® style rail openings without the use of specialized nuts and fasteners. The locking shoe mechanisms provide a quick and secure integrated interface connection. The locking shoe mechanism of the RIS of this invention may be integrated into the design and functionality of any particular weapon accessory or accessory mount. In an exemplary embodiment, the RIS of this invention is incorporated into a weapon light mount used with a weapon component having conventional M-Lok style rail openings.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DETAILED DESCRIPTION

Figure 1:
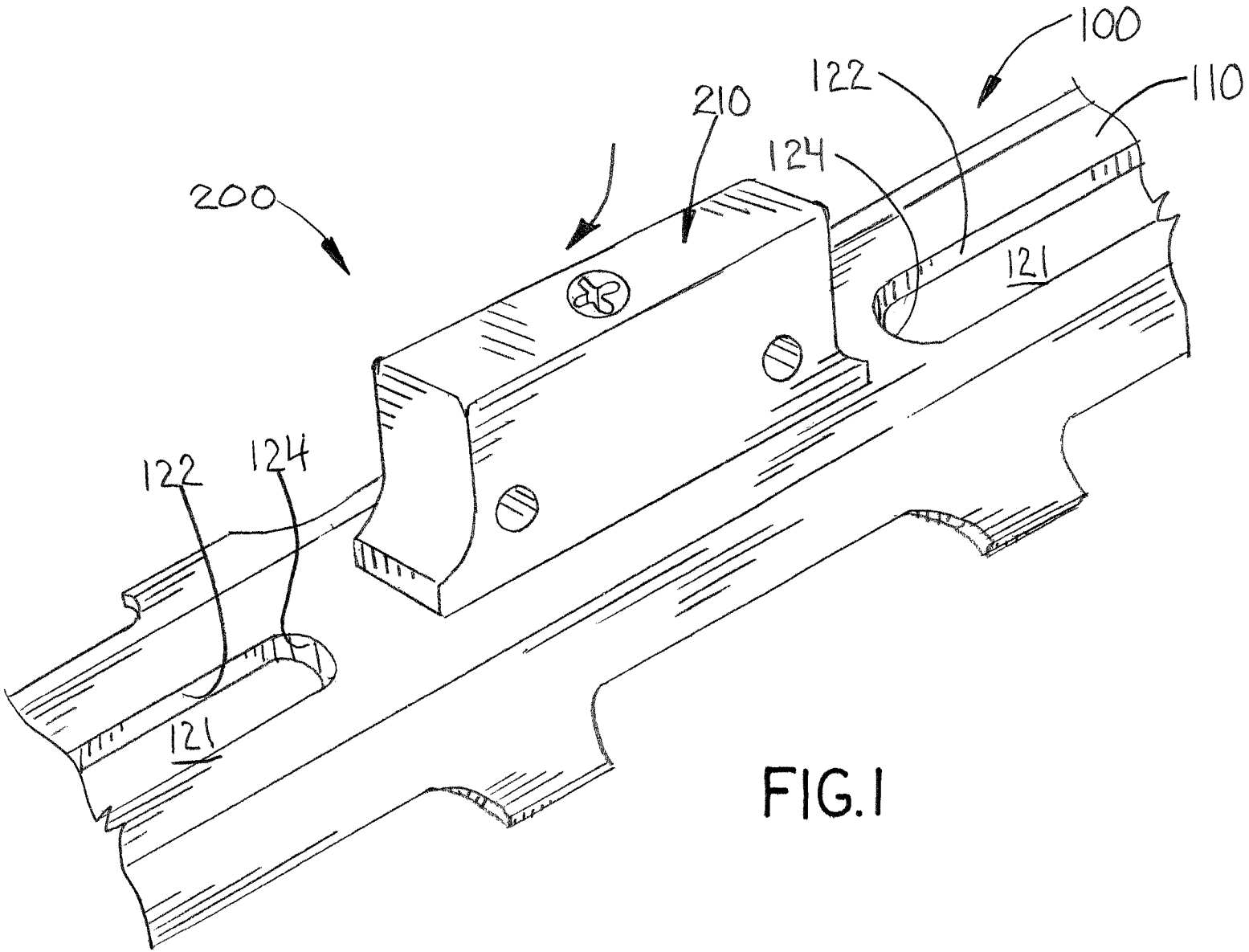
FIG. 1 is a perspective view of an exemplary embodiment of the rail interface systems of this invention shown using an embodiment of a rail section and a weapon light mount.

In the following detailed description of the exemplary embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical, structural and mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The drawings illustrate exemplary embodiments of the improved rail interface systems ("RIS") of this invention. The RIS of this invention consists of complimentary components and component features that interface to securely attach the weapon accessory to the weapon or weapon component. In particular, the complimentary features and components of the RIS of this invention consist of a series of interface or "rail" openings formed in the weapon or weapon component and a lever mechanism incorporated into the weapon accessory that pivots to extend through and restrictively engage the edges of the opening thereby securely affixing the weapon accessory against the weapon or weapon component.

The rail openings used as part of the RIS of this invention may be formed in any weapon structure or component to which an accessory may be attached, but are most commonly formed in the hand guards or receivers. Furthermore, the arrangement and location of the rail opening on the weapon or weapon component may vary depending on application and purpose. The rail openings may all be of similar or identical size. In other alternative embodiments, rail openings can have differing sizes. Furthermore, the rail openings may or may not have consistent or constant lengths (the longer dimension of an opening) or widths (the smaller dimension of an opening). As illustrated throughout this disclosure, the rail openings can be arranged in rows such that the longer dimension of each opening is aligned with the longer dimension of at least one other opening.

In the RIS system of this invention, a spring tensioned sliding shoe is used to engage the edges of rail openings and the inner surface of the rail section, which securely hold the accessory component to the rail section. The spring tensioned sliding shoe mechanism may be integrated into the design and functionality of any particular weapon accessory. The lever mechanisms of this invention may be incorporated directly into the design of a weapon accessory or into the design of a mount for any such accessory. The lever mechanisms may be incorporated into weapon accessories, such as Picatinny® rail sections, handle grips, lights, lasers, and sling connections.

Ideally, the RIS of this invention is adapted to utilize M-Lok® style rail openings (the elongated slots for M-Lok® without the using M-Lok® style fasteners. The sliding shoe mechanism eliminates the need for separate M-Lok® fasteners with existing weapons and weapon components having M-Lok® style rail openings, while still providing a quick, convenient and secure integrated interface connection. In other alternative embodiments, the sliding shoe mechanisms can be modified and adapted to interface with the rail openings of any configuration or dimension as required.

Figure 2:
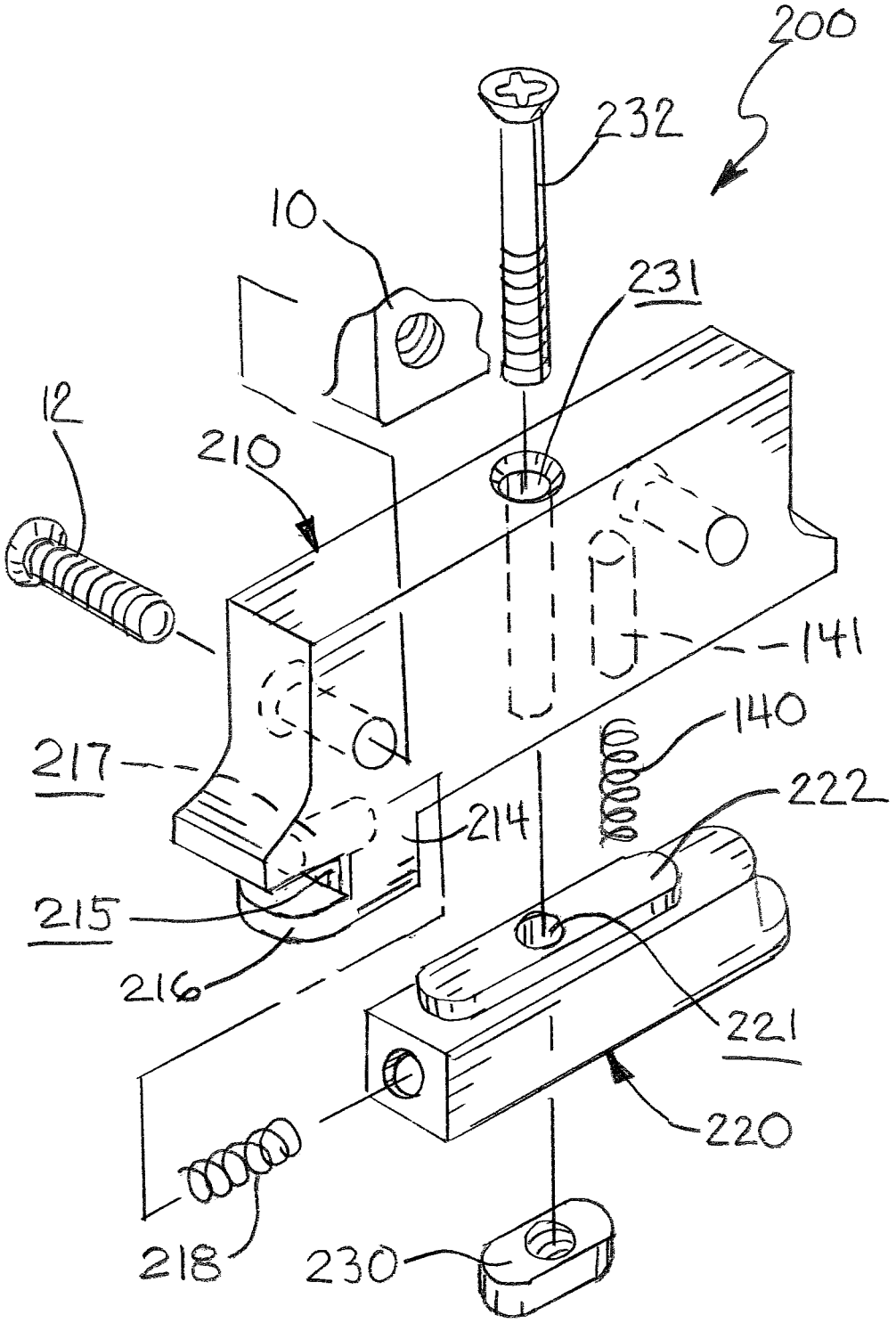
FIG. 2 is an exploded view of the light mount of FIG. 1.
Figure 3:
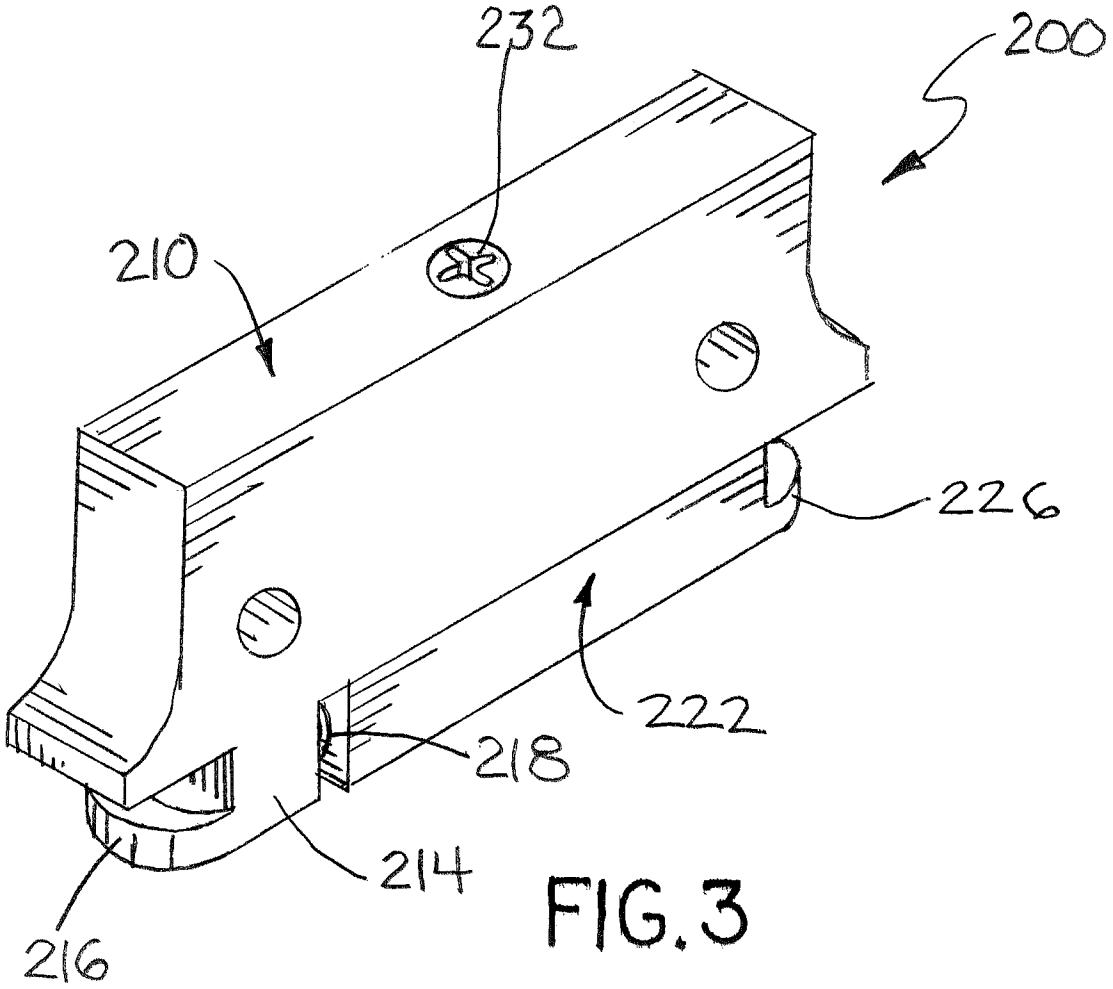
FIG. 3 is a top perspective view of the light mount of FIG. 1.
Figure 4:
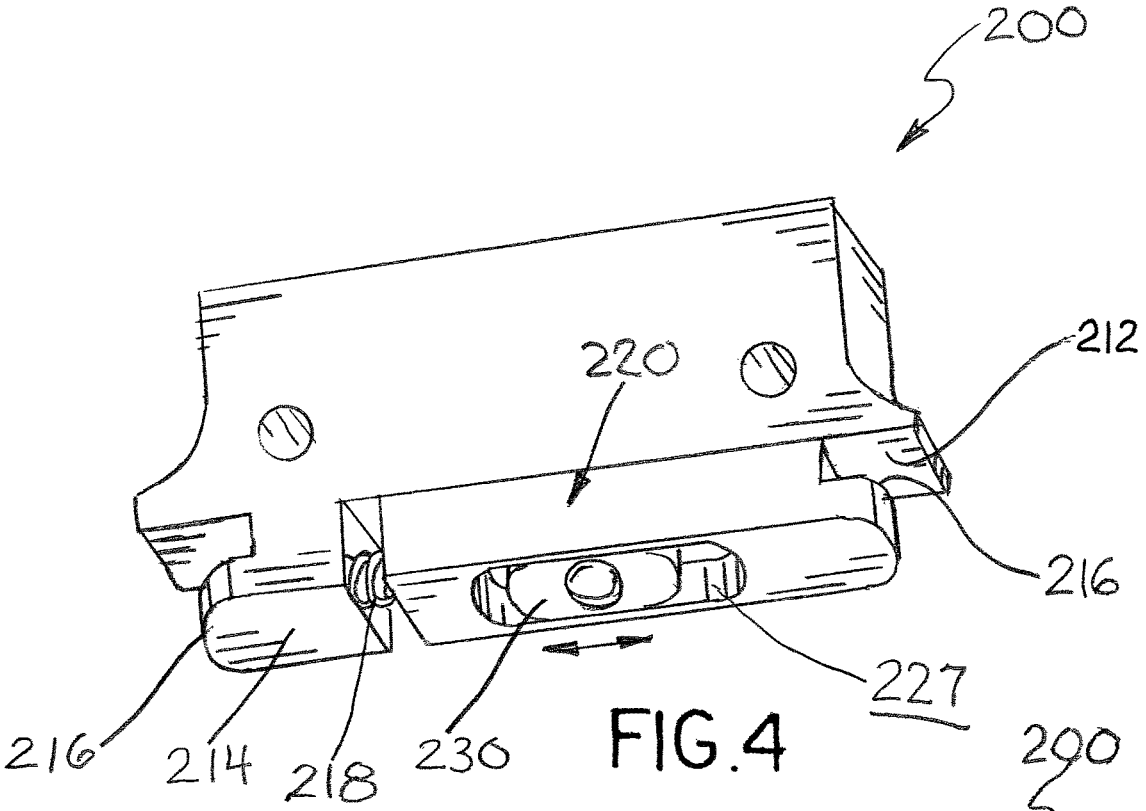
FIG. 4 is a bottom perspective view of the light mount of FIG. 1.
Figure 5:
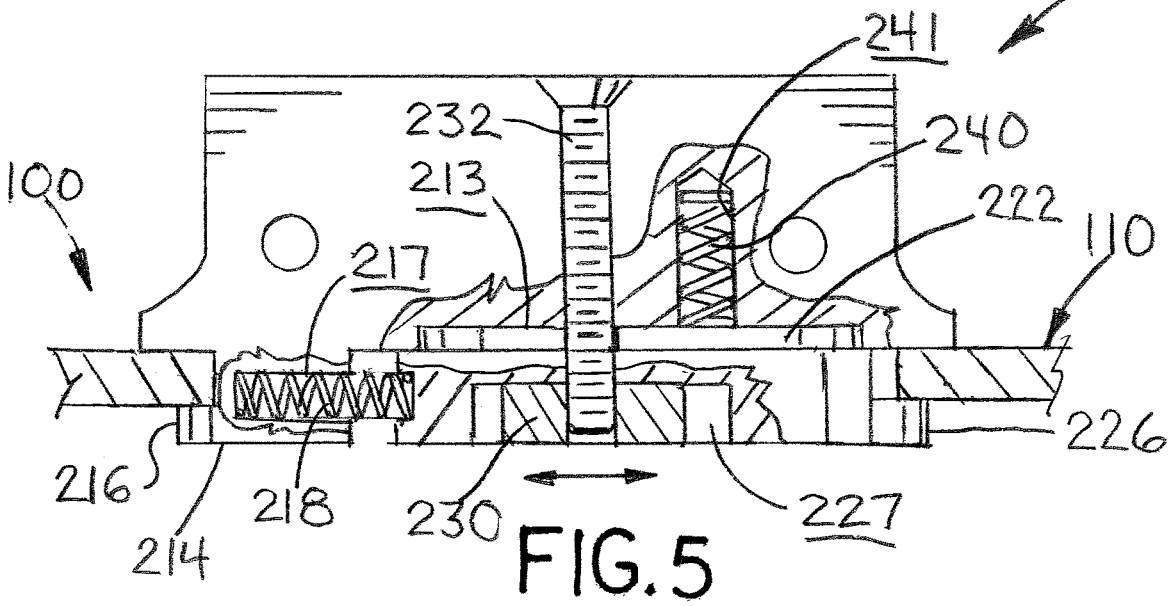
FIG. 5 is a side sectional view of the light mount of FIG. 1 shown with the shoe in the locked position.

Referring now to the drawings, FIGS. 1-5 illustrate the RIS of this invention using an exemplary embodiment of a weapon rail panel 100 and an exemplary embodiment of mount 200. Generally, rail covers are commonly used to cover weapon rails and hand guards on M16/M4 style rifles and other rail systems. As shown, rail panel 100 is a simplified depiction of a section of a conventional rail section of a firearm hand guard (not shown) of the kind used on AR-15 style rifles. Mount 200 is illustrated as light/laser mount to which a weapon light or laser 10 (only partially not shown) is affixed.

Rail section 100 is of conventional construction and may be machined, cast, molded or extruded from any suitable metal, plastic or composite material. Rail section 100 has an elongated rail body 110 having a subtle arcuate cross section with an outer surface 112 and an inner surface 114. Rail section 100 also has a plurality of elongated "M-Lok" style rail openings 121 (four slots are shown). Rail openings 121 are longitudinally aligned in a row formed along the longitudinal axis of rail body 110. Ideally, rail openings 121 are configured and dimensioned to be M-Lok compliant. As shown, each rail opening 121 is defined by a peripheral edge having opposed parallel side edges 122 and rounded end edges 124.

Light mount 200 is generally cast, formed or molded of a suitable metal or plastic, which is selected to provide the desired durable, texture and thermal insulating properties. Light mount 200 includes a mount body 210 that is adapted to support a conventional weapon light, a laser or similar device (not shown). The light, laser or other device is affixed to mount body 210 by fasteners that turn into threaded lateral bores in the mount body. Mount body 210 includes an integral L-shaped protrusion ("under-hook") 214 that extends from its bottom surface 212 at one end of the mount body. Body protrusion 214 terminates in a foot 216 that extends parallel to bottom surface 212. Body protusion 214 is configured and dimensioned to abut against the rounded contour of side edge 122 of rail opening 121. In addition, foot 216 is spaced from bottom surface 212 to receive side edge 122 there between.

Mount 200 also includes a spring tensioned "locking" shoe 220 that slides along bottom surface 212 of mount body 410 for movement between an unlocked position and a locked position. Shoe 220 is an elongated piece dimensioned to extend through rail opening 121. Shoe 220 has a raised guide shoulder 222 that shiftably seats within a longitudinal channel 213 formed in bottom surface 212 of mount body 210. Shoe 220 is held against bottom surface 212 by a nut 230 and bolt 232. Bolt 232 extends through bore 231 in mount body 210 and a longitudinal slot 221 in shoe 220. Bolt 232 turns into nut 230, which shiftably seats in a second longitudinal slot 227 formed in the bottom of shoe 220. Tightening bolt 232 locks shoe 220 in place against mount body 210 to hold the shoe in either the open or locked position. A foot 226 (extends longitudinally from the distal end of shoe 220, which form corresponding "under-hook" for the shoe opposite body protrusion 214. Similar to protrusion 214, the distal end of shoe 220 is configured and dimensioned to abut against the rounded contour of side edge 122 of rail opening 121 and foot 226 is located to receive side edge 122 between the foot and bottom surface 212. A coil spring 218 is disposed between protrusion 214 and shoe 220 to urge the shoe towards its unlocked position. One end of spring 218 is seated within a longitudinal bore 217 formed in protrusion 214 and the other end is seated in a shallow longitudinal bore 227 in shoe 220. A second string 240 is seated within a bore 241 within mount body 210 which slightly urges shoe 220 away from bottom surface 212.

Light mount 200 attaches to rail section 100 by manually pressing shoe 220 inward against protrusion 214 and tightening bolt 232 to hold the shoe in the unlocked position. Once secured in the unlocked position, shoe 220 and protrusion 214 are inserted into rail opening 121. Once inserted, bolt 232 is loosened allowing shoe 220 to slide away from protrusion 214 under the force of spring 218 to the locked position. In the locked position, protrusion 214 and shoe 220 abut against the opposite rounded end edges 124 of rail opening 121 with feet 216 and 226 seated against the inner surface 114 of rail body 110. Once shoe 220 is in the locked position, bolt 232 is tightened securing shoe 220 against mount body 210 within rail opening 121. Mount 200 detaches from rail section 100 by loosening bolt 232. Once bolt 232 is loosened, mount body 210 is manually shifted within rail opening 121 towards the "shoe end" which compresses spring 218 and allows protrusion 214 to be pivoted outward from rail opening 121. Once the protrusion is freed, mount 200 can be fully removed from rail section 100.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A rail interface system for connecting an accessory component to a weapon component, the interface system comprising:

the weapon component having a first rail surface, a second rail surface, and at least one through rail opening extending between the first surface and the second surface, the rail opening defined by a peripheral edge formed between the first surface and the second surface, the peripheral edge having opposed end edges; and the accessory component including an accessory body having a contact surface and a shoe connected to the accessory body for sliding movement along the contact surface between a locked position and an unlocked position to secure the accessory component to the weapon component with the contact surface abutting the first rail surface, the accessory body also includes a body protrusion extending from the contact surface, and a spring operatively engaged between the protrusion and the shoe to urge the shoe toward the locked position, the body protrusion and shoe extend through the rail opening and restrictively engage against the opposed end edges when the shoe is in the locked position and are spaced from the opposed end edges when the shoe is in the unlocked position.

2. The interface system of claim 1 wherein the shoe has a first end and a second end thereof, the shoe second end restrictively engaging one of the opposed end edges and the second rail surface when the shoe is in the locked position and disengaged from the one of the opposed end edges and the second rail surface when the shoe is in the unlocked position.

3. The interface system of claim 2 wherein the shoe second end includes a foot extending there from, the foot seated under the second rail surface when the shoe is in the unlocked position.

4. The interface system of claim 1 wherein the accessory body has an elongated channel defined within the contact surface, the shoe includes a shoulder shiftably seated within the channel.

5. The interface system of claim 1 wherein the accessory body includes a second spring operatively engaged with the shoe to urge the shoe from the contact surface.

6. The interface system of claim 1 wherein the shoe has a longitudinal shoe slot defined therein, the accessory component includes a bolt extending through a bore in the accessory body into the shoe slot and a nut shiftably seated within the shoe slot and turned onto the bolt for securing the shoe to the accessory body in either the unlocked position or the locked position.

7. A rail interface system for connecting an accessory component to a weapon component, the interface system comprising:

the weapon component having a first rail surface, a second rail surface, and at least one through rail opening extending between the first surface and the second surface, the rail opening defined by a peripheral edge formed between the first surface and the second surface, the peripheral edge having opposed end edges; and the accessory component including an accessory body having a contact surface and a shoe connected to the accessory body for sliding movement along the contact surface between a locked position and an unlocked position to secure the accessory component to the weapon component with the contact surface abutting the first rail surface, the accessory body includes a body protrusion extending from the contact surface, the accessory body has an elongated channel defined within the contact surface, the accessory body also includes a spring operatively engaged with the shoe to urge the shoe toward the locked position, the shoe has a first end and a second end thereof and includes a shoulder shiftably seated within the channel, the shoe also has a longitudinal shoe slot defined therein, the accessory component also includes a bolt extending through a bore in the accessory body into the shoe slot and a nut shiftably seated within the shoe slot and turned onto the bolt for securing the shoe to the accessory body in either the unlocked position or the locked position, the body protrusion and shoe extend through the rail opening and restrictively engage against the opposed end edges when the shoe is in the locked position and are spaced from the opposed end edges when the shoe is in the unlocked position, the shoe second end restrictively engaging one of the opposed end edges and the second rail surface when the shoe is in the locked position and disengaged from the one of the opposed end edges and the second rail surface when the shoe is in the unlocked position, the shoe second end includes a foot extending there from, the foot seated under the second rail surface when the shoe is in the unlocked position.

8. The interface system of claim 7 wherein the accessory body includes a second spring operatively engaged with the shoe to urge the shoe from the contract surface.

9. A rail interface system for connecting an accessory component to a weapon component, the interface system comprising:

the weapon component having a first rail surface, a second rail surface, and at least one through rail opening extending between the first surface and the second surface, the rail opening defined by a peripheral edge formed between the first surface and the second surface, the peripheral edge having opposed end edges; and the accessory component including an accessory body having a contact surface and a shoe connected to the accessory body for sliding movement along the contact surface between a locked position and an unlocked position to secure the accessory component to the weapon component with the contact surface abutting the first rail surface, the accessory body also includes a body protrusion extending from the contact surface, the body protrusion and shoe extend through the rail opening and restrictively engage against the opposed end edges when the shoe is in the locked position and are spaced from the opposed end edges when the shoe is in the unlocked position, the shoe has a longitudinal shoe slot defined therein, the accessory component includes a bolt extending through a bore in the accessory body into the shoe slot and a nut shiftably seated within the shoe slot and turned onto the bolt for securing the shoe to the accessory body in either the unlocked position or the locked position.

10. The interface system of claim 9 wherein the shoe has a first end and a second end thereof, the shoe second end restrictively engaging one of the opposed end edges and the second rail surface when the shoe is in the locked position and disengaged from the one of the opposed end edges and the second rail surface when the shoe is in the unlocked position.

11. The interface system of claim 10 wherein the shoe second end includes a foot extending there from, the foot seated under the second rail surface when the shoe is in the unlocked position.

12. The interface system of claim 9 wherein the accessory body has an elongated channel defined within the contact surface, the shoe includes a shoulder shiftably seated within the channel.

13. The interface system of claim 9 wherein the accessory body also includes a spring operatively engaged with the shoe to urge the shoe toward the locked position.

14. The interface system of claim 13 wherein the spring is positioned between the protrusion and the shoe.

15. The interface system of claim 13 wherein the accessory body includes a second spring operatively engaged with the shoe to urge the shoe from the contact surface.

* * * * *